US005641094A

United States Patent [19]

Wunsch

[11] Patent Number: 5,641,094

[45] Date of Patent: Jun. 24, 1997

[54] METHOD AND DEVICE FOR TAKING-OUT OF FLUIDS FROM CONTAINERS

[75] Inventor: Erich Wunsch, Bad Liebenzell, Germany

[73] Assignee: Eckart Wunsch, Schomberg-Langenbrand, Germany

[21] Appl. No.: 425,376

[22] Filed: Apr. 20, 1995

[30] Foreign Application Priority Data

Apr. 20, 1994 [DE] Germany ..... 44 13 709.5

[51] Int. Cl.[6] ..... B67D 5/08

[52] U.S. Cl. ..... 222/61; 222/396; 222/400.8

[58] Field of Search ..... 222/1, 61, 394, 222/396, 399, 400.7, 400.8, 401, 402

[56] References Cited

U.S. PATENT DOCUMENTS

| | | | |
|---|---|---|---|
| 3,014,620 | 12/1961 | Moore | 222/394 |
| 3,347,418 | 10/1967 | Fefferman | 222/61 |
| 4,132,242 | 1/1979 | Carroll, Jr. | 222/61 X |
| 4,921,135 | 5/1990 | Pleet | 222/396 X |
| 5,012,955 | 5/1991 | Shannon | 222/61 |
| 5,273,188 | 12/1993 | Sanino | 222/61 |

FOREIGN PATENT DOCUMENTS

| | | |
|---|---|---|
| 7441775 U | 5/1975 | Germany . |
| 3429559A1 | 2/1986 | Germany . |

*Primary Examiner*—Joseph Kaufman

*Attorney, Agent, or Firm*—Scully, Scott, Murphy & Presser

[57] ABSTRACT

A method for the removal or dispensing of liquids from containers, especially for the tapping of beer, in which pursuant to the quantity of liquid withdrawn, air is introduced into the container for pressure compensation or for the generating of an atmospheric pressure. Furthermore, also disclosed is a device for the dispensing of liquids from containers, especially a beer tapping device which is exchangeably connectable with the containers for effecting the withdrawal of the liquids and which essentially possesses a unitarily or multi-part constructed removal housing including a liquid-withdrawing tap, as well as passageways, bores, conduits or the like for the removal of the liquid and for the infeed of air.

9 Claims, 2 Drawing Sheets

METHOD AND DEVICE FOR TAKING-OUT OF FLUIDS FROM CONTAINERS

BACKGROUND OF THE INVENTION

1. Field of the Invention

The present invention relates to a method for the removal or dispensing of liquids from containers, especially for the tapping of beer, in which pursuant to the quantity of liquid withdrawn, air is introduced into the container for pressure compensation or for the generating of an atmospheric pressure. Furthermore, the invention also pertains to a device for the dispensing of liquids from containers, especially a beer tapping device which is exchangeably connectable with the containers for effecting the withdrawal of the liquids and which essentially possesses a unitarily or multi-part constructed removal housing including a liquid-withdrawing tap, as well as passageways, bores, conduits or the like for the removal of the liquid and for the infeed of air.

2. Discussion of the Prior Art

The opening of beer cans or other commonly employed beer containers (cans, barrels or small casks) and the withdrawal or removal of the liquid from the can or the container is basically known. The opening of the container is, in general, carried out through the intermediary of a stopper or plug which closes a bung hole located in the cover of the container or of the beer can. Tapping conduits and tapping spigots are also already described in the patent literature, for example, in German Patent Publication No. DE 34 29 559 C2.

In this known device pursuant to German Patent Publication No. DE 34 29 559 C2, the tapping tube is fixedly connected with a mounting which is constructed as a single-armed lever and which is suspendable by means of a claw on a beaded rim of a beer can. By means of this device there is only facilitated a simple outflow of the beer from the beer can in the absence of any pressure. However, in order to also be able to achieve a complete outflow for liquids which do not stand under pressure, it is necessary to provide for the formation of an opening in the upper region of the container, as a result of which the atmospheric pressure can act on the liquid which is stored in the container.

The disclosure of German Petty Patent No. GM 74 41 775 describes an adapter for beer tapping apparatus, in which there is provided an exchangeable compressed-gas cartridge, from which there egresses a pressurized gas and through the use of a connector acts against the liquid in the container. As a consequence, there is attained a discharging of liquid after the opening of a valve or tapping spigot.

In the trade there are additionally known devices for the withdrawal of liquids from a container, in which the liquid is subjected to carbon dioxide, as a result of which there is generated the necessary pressure for the explosion of the liquid (the beer) from the container. Finally, in practice, there are also known devices wherein through a manually-operable air pump, or respectively, a piston-cylinder unit, in accordance with need, there is exerted the necessary (air) pressure against the liquid in the container, in order to facilitate an outflow at an opened discharge tube.

The above-mentioned devices all are subject to the disadvantage that either a gas is added to the liquid which, particularly for comestibles, is frequently found to be inexpedient, and due to the constant escape and thereby in view of an adverse influence over the quality of the liquid, leads to the rejection thereof. Moreover, it is also possible to manually exert an uncontrolled pressure against the liquid, so that at any one time there is produced a weak and then again an excessively strong jet or stream of liquid. In addition thereto, it has been ascertained as a further disadvantage that the manual generation of an air pressure is complex and necessitates a significant demand of energy.

SUMMARY OF THE INVENTION

Proceeding from the above-mentioned state of the technology, it is accordingly an object of the invention to provide a method and a device of the above-mentioned type, in which for the discharge of the liquid, there is achieved the necessary, but in accordance with need a variably adjustable pressure, in the absence of any foreign gas and without any manual expenditure of energy, in a technologically simple manner.

Inventively, the foregoing object is achieved in that the method as described hereinabove, has electric motor-generated compressed air filled above the liquid level in the essentially air-tightly sealed container, the pressure of which is adjustable and which lies above atmospheric air pressure. The device for implementing the inventive method utilizes the aspect that the withdrawal of the liquid from the container is implemented through electric motor-generated compressed air.

In accordance with the inventive method, through the activation of an electric motor, compressed air is generated by mans of a compressor or a pump, which is conducted onto the surface of the liquid at a predetermined pressure, and thereby effectuates the discharge of the liquid from the container under a constant jet or stream. Inasmuch as the air pressure is automatically and independently adjustable, in accordance with the pressure conditions reigning in the interior of the container, during the withdrawal of liquid, it is always again optimally re-regulated through the system itself.

This, in principle, electrical beer tapping apparatus renders easier the application of an air pressure against the liquid in the container, and due to the control by means of a differential-pressure switch, affords a constantly uniform-remaining or, as desired, also a variable pressure. As soon as the pressure falls below a specified pressure limit of; for example, 100 mbar, it is again automatically built-up. A further advantage consists of that this device also facilitates the installation of larger containers than was heretofore the instance with the usual tapping devices for party cans or small party casks. In case the liquid should not be fully withdrawn subsequent to tapping, then by means of the activated operating condition, a pressure which could possibly be lost during the inactive or idle period, can be constantly built up to the required extent. This constant air pressure over a lengthier period of time over a number of days causes the carbon dioxide which; for example, is in the beer, to remain maintained, so that even after a few days this contributes to an optimum quality and freshness of the beverage, and for a foam formation in the beer.

BRIEF DESCRIPTION OF THE DRAWINGS

In the drawings there is represented an example of the invention, in which.

DETAILED DESCRIPTION

Figure 1:
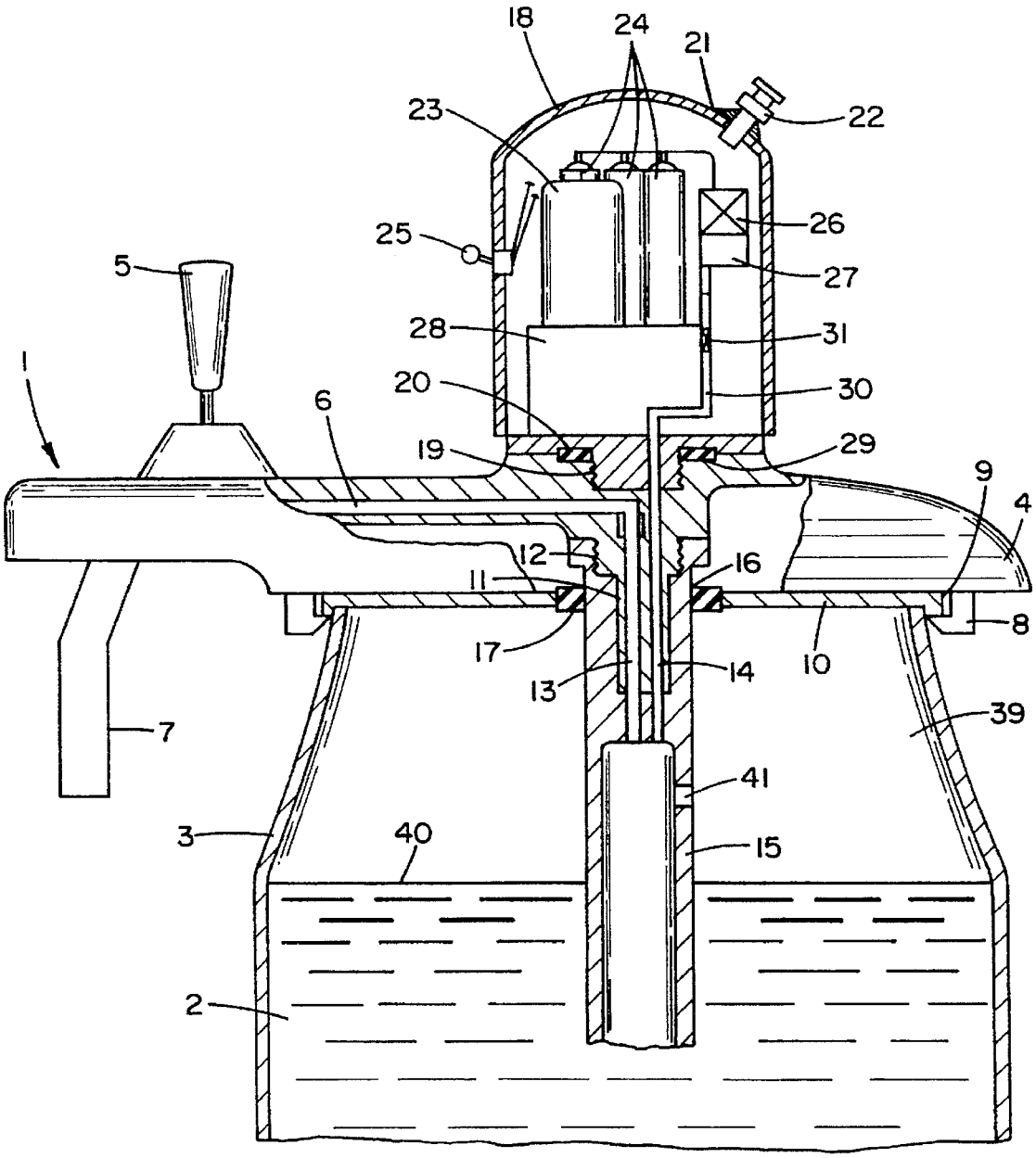
FIG. 1 illustrates a beer tapping apparatus pursuant to the inventive type, shown partially in section.

The device 1 for the withdrawal or dispensing of liquids 2; for example, such as beer, from a container 3; for instance, a five-liter beer-receiving cask, consists essentially of an attachable housing 4 with a tap spigot 5 and an internal through-passageway 6 which, at its discharge end, terminates into a discharge tube 7 in a known and therefore herein not more closely detailed manner. The attachable housing 4 is fixedly connected with the container 3 by means of a collar or claws 8 which engage beneath a beaded rim 9 on the cover 10 of the container 3. Hereby, at least the front claw is subjected to spring pressure and is movably constructed.

The attachable housing 4 possesses a downwardly directed extension 11 which has an external screw thread 12 and in the interior has a channel or a bore 13 for the withdrawal of liquid, and a second channel or a second bore 14 for the infeed of air to the internal space of the container 3. Screwed onto the screwthread 12 is a riser tube 15 which extends through an opening 16 in the cover into the container 3. A seal 17 is arranged between the opening in the cover and the riser tube. The riser tube 15 extends downwardly up to an extremely short distance above the bottom of the container 3 so as to facilitate the most possibly complete discharge of the liquid 2. A small side opening 41 in the riser tube 15 enables the inflow of air 39 into the container 3. This inflowing air 39 lies on the liquid level 40.

Fastened on the attachable housing 4 is a hood 18 through the use of a screw connection 19, and with the interposition of a seal 20. This hood 18 possesses in its upper region an air inlet opening 21 which is closable by means of a valve or manually through a plug 22 of known type.

Figure 2:
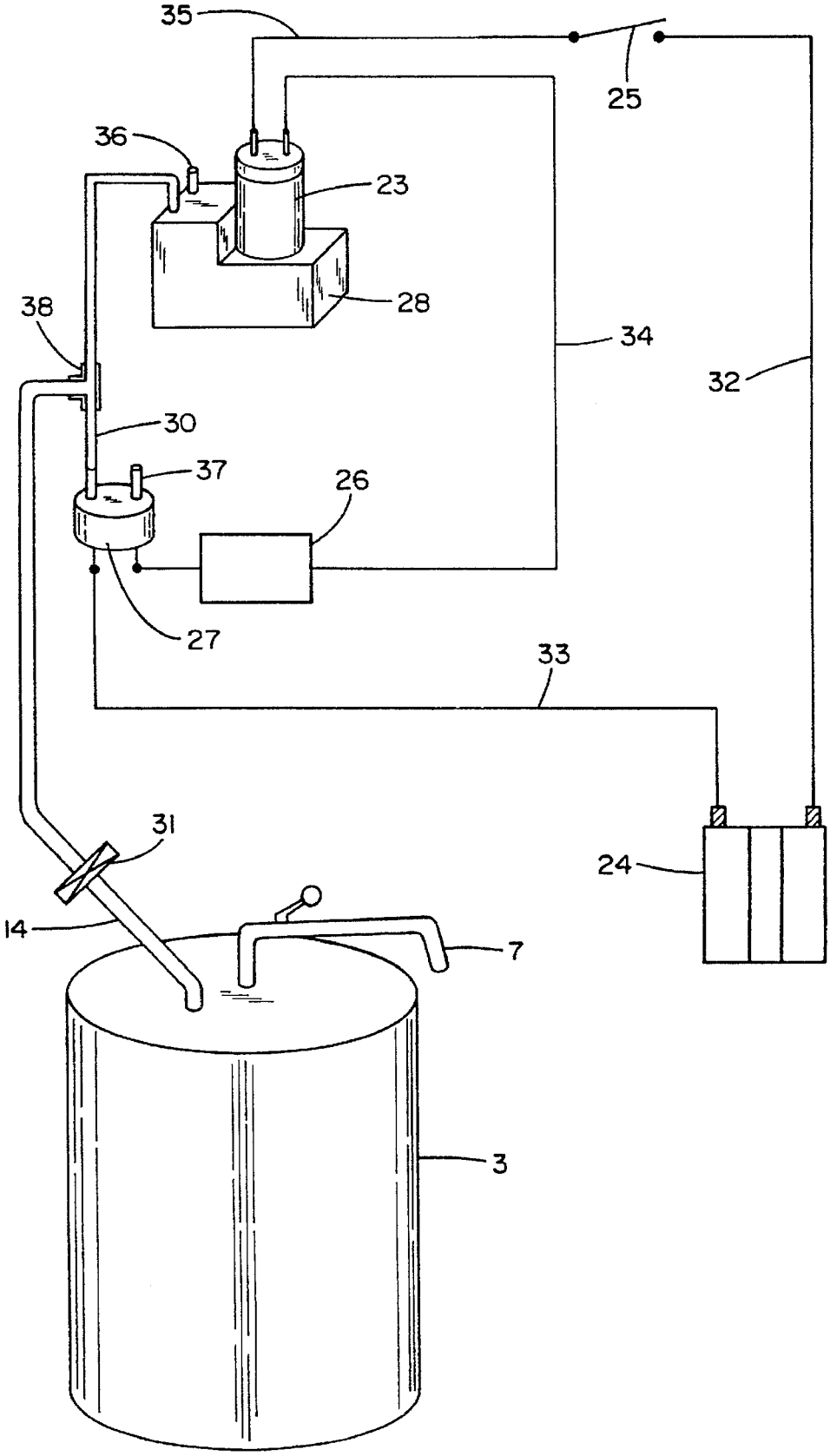
FIG. 2 illustrates a switching schematic for the electric motorized operation of the beer tapping apparatus of FIG. 1.

In the internal space of the hood 18 there is located an electric motor 23, which is electrically connected to batteries 24 or rechargeable accumulators, and which is switchable either on or off by means of a main or system switch 25. The electric motor 23 is further in electrical connection with an electronic device 26 which, in a particular manner, in dependence upon the air pressure reigning in the container 3 controls its operating condition by means of a therewith connected pressure-differential switch 27. The electrical line connections 32, 33, 34 and 35 leading from the batteries/accumulators 24 to the switch 25 and through the electronic device 26 to the electric motor 23 are clearly represented in FIG. 2.

The main switch or also the system switch 25 is connected through the line 32 with the batteries or accumulators 24 and through the line 35 with the electric motor 23. A further electrical connection 33 extends from the batteries or accumulators 24 to the pressure-differential switch 27 and from there to the switch or control electronic device 26 which, in turn, is connected through the line 34 with the second pole of the electric motor 23.

The electric motor 23 acts on a compressor or a pump 28, which can be constructed as a micromembrane or piston pump, and through the suction connector 36 aspirates the surrounding air through the opening 21 in the hood 18, and discharges in the passageway 14 which is conducted through the lower screwthreaded connection 29, in a compressed form. An air conduit 30 which branches off from the passageway or the conduit 14 leads to the pressure-differential switch 27 which possesses an output connector 37 for connection with the surrounding air or atmosphere. Upstream of the branch-off 38 and downstream of the inlet into the container 3, there is additionally located in the passageway 14 a non-return valve 31 or similar operative element. This non-return valve can also be built into the attachable housing 4 with the tap spigot 5. The non-return valve 31 serves to ensure that no liquid 2 can resultingly penetrate into the pressure-differential switch 27.

The pressure-differential switch 27 is set in such a manner that it activates the electric motor 23 generally concurrently with the opening of the tap spigot 5 for the liquid discharge, when the main or system switch 25 has been previously actuated. As a result, there is afforded an almost constant pressure within the container 3 which significantly assists in that the carbon dioxide in the beer remains maintained over a number of days and does not escape. Accordingly, the beverage remains fresh. Furthermore, even after a few days it is thereby still possible to provide for the formation of a foam in the beer during tapping thereof.

An increase in the pressure within the container 3 among other circumstances, can also facilitate for particular liquids or media the discharge; for example, of whipped cream.

For effecting the actuation of the device 1, the attachable housing 4 with the riser tube 15 is connected with the container 3. Thereafter, the hood 18 with the internally located aggregates is screwed thereon. The mechanical connecting locations are concurrently sealed. Prior to the switching on of the electric motor unit by means of the switch 25, there is opened the tap spigot 5 in order to reduce the pressure which has been formed in the container 3. After already a short period of time (discharge of a half or a full glass of liquid) is the valve 22 in the hood 18 opened, and the main switch 25 is switched on. The system now regulates itself and from then on requires no further operating and special servicing.

For example, when the pressure in the container 3 falls below a pressure of 100 mb above atmospheric pressure, then by means of the differential pressure switch 27 and the electronic device 26, the electric motor 23 switches itself on, which controls the operation of the compressor or, respectively, the pump 28. The pressure is thereby again built up to the inputted pressure limit of 100 mb above atmospheric pressure. Upon the reaching of the pressure limit in the container 3, the electric motor 23 is again automatically switched off.

When a residual liquid remains in the container 3, then the main or system switch remains switched on, so that over the period of time until the subsequent use, the slowly escaping air pressure can always again be built up. Normally, of from within one day or two days will a pressure replacement not be necessary, inasmuch as the entire system is well sealed with regard to the outside. The constant air pressure in the container 3 acting on the liquid 2 causes the carbon dioxide which is present; for example, in the beer, to remain maintained and also even after a few days to render possible to provide a good formation of foam in the beer.

What is claimed is:

1. A device for the dispensing of liquids from a container through the application of compressed air on the liquid level of a quantity of liquid in said container; comprising a first housing structure exchangeably mounted in sealing relationship on an upper end of said container, said first housing structure including a depending riser tube extending downwardly into said container and passageways for respectively the withdrawal of liquid from said container and for the infeed of compressed air, a dispensing spigot for liquid being in communication with one said passageway, a further said passageway having an inlet connected to compressor means for said compressed air and an outlet terminating in said riser tube for liquid withdrawal above the liquid level in said container; a second housing structure mounted on said first housing structure having a closeable air inlet opening, said second housing structure being sealingly and exchangeably fastened to said first housing structure, said second housing structure containing said compressor means, a drive motor for said compressor means, control and switching electronic means and a differential-pressure switch, said switch being operatively connected with said compressed air infeed passageway and with atmospheric air so as to control the operating condition of said drive motor for the compressor means through the therewith connected control and switching electronic means in dependence upon the air pressure acting on the liquid level.

2. A device as claimed in claim 1, wherein said compressor means comprises a pump.

3. A device as claimed in claim 1, wherein the air pressure acting on said liquid level is about 100 mb above atmospheric pressure.

4. A device as claimed in claim 1, wherein a manually operable system switch is operatively connected with said drive motor.

5. A device as claimed in claim 1, wherein a manually operable main supply switch is operatively connected with said drive motor.

6. A device as claimed in claim 1, wherein a non-return valve is located in the compressed air infeed passageway upstream of said pressure-differential switch.

7. A device as claimed in claim 1, wherein said liquid is beer and said device is a beer tapping-off installation.

8. A device as claimed in claim 7, wherein said container comprises a beer keg.

9. A device as claimed in claim 7, wherein said container comprises a beer can.

* * * * *